US006764073B2

(12) United States Patent
Kaya et al.

(10) Patent No.: US 6,764,073 B2
(45) Date of Patent: Jul. 20, 2004

(54) ADJUSTABLE GRIPPING DEVICE FOR ADJUSTABLE SHEET-RECEIVING POCKETS AND METHOD FOR ADJUSTING SHEET-RECEIVING POCKETS

(75) Inventors: Mehmet Oktay Kaya, Lee, NH (US); Heiner Philipp Luxem, Durham, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 21 days.

(21) Appl. No.: 10/178,645

(22) Filed: Jun. 24, 2002

(65) Prior Publication Data

US 2003/0234481 A1 Dec. 25, 2003

(51) Int. Cl.[7] ..... B65H 5/30

(52) U.S. Cl. ..... 271/223; 271/294; 270/52.19; 270/52.25; 270/52.24

(58) Field of Search ..... 270/52.19, 52.2, 270/52.23, 52.24, 52.25, 58.19; 271/294, 223

(56) References Cited

U.S. PATENT DOCUMENTS 4,046,367 A * 9/1977 Merker et al. ..... 270/52.24
4,723,770 A 2/1988 Seidel et al.
4,988,086 A 1/1991 Schlough
5,024,432 A 6/1991 Thünker et al.
5,112,036 A * 5/1992 Hatt ..... 270/52.23
5,911,416 A * 6/1999 Klopfenstein ..... 271/223
6,311,968 B1 11/2001 Linder et al.

* cited by examiner

*Primary Examiner*—Christopher P. Ellis
*Assistant Examiner*—Mark A. Deuble
(74) *Attorney, Agent, or Firm*—Laurence A. Greenberg; Werner H. Stemer; Gregory L. Mayback

(57) ABSTRACT

An adjustable gripper system for releasably holding at least one sheet against a surface includes an adjustment body, a gripper connected thereto for holding the sheet against the surface, and a cam follower to be actuated by a cam. The cam follower is connected to the adjustment body and displaces the adjustment body dependent upon a cam position, which correspondingly displaces the gripper along the surface. The system can be part of a sheet-collating pocket having a top portion, forward and rearward walls pivotally connected to one another and defining a sheet-receiving opening, which pocket can be part of a sheet-collating machine having the cam, a conveyor, a sheet feeding device, and other pockets. A method for adjusting the grippers positions the cam in the pocket path to contact each and selectively displace the gripper holding portion with dependent upon the cam position while the cam and pocket contact.

23 Claims, 11 Drawing Sheets

ADJUSTABLE GRIPPING DEVICE FOR ADJUSTABLE SHEET-RECEIVING POCKETS AND METHOD FOR ADJUSTING SHEET-RECEIVING POCKETS

BACKGROUND OF THE INVENTION

1. Field of the Invention

The invention lies in the field of printing presses. The present invention relates generally to a sheet-conveying apparatus, for example, for conveying newspapers, and, more particularly, to a sheet conveying apparatus having collating pockets moving on a track. In particular, the invention relates to an adjustable gripping device for holding folded sheet material sections in such a collating pocket and for separating folded ends of the sections from one another to allow nesting of inserted other sections.

2. Background Information

Sheet-conveying devices, in particular, devices for conveying newspapers, are required to be able to insert or nest or collate various sets of sheets inside one another. Specifically, to create a finished newspaper, a first folded section of the paper, taking the form of a folded sheet section, is opened and at least one second section of the newspaper is inserted between the two sides of the folded sheet section. It is possible that the second section is, itself, a section having third, fourth, or more other sections nested therein in the same manner as the first section. To process such sheets, in particular, newspapers, prior art conveying devices have an angle-shaped pocket that first picks up a first section, opens the first section, and then conveys the opened first section to a delivery station. Prior art systems including pockets include, for example, U.S. Pat. No. 4,133,521 to Müller and U.S. Pat. No. 5,213,318 to Newhall. A delivery unit drops the second section into the opened first section to create a nested paper with two sections. This process can be repeated for many different sections to create an entire newspaper.

There is a difficulty associated with the pocket properly opening the first section to the appropriate opening position. To facilitate proper opening, each section is formed with a lap. In other words, the two ends of the folded sheet section are not even. Typically, in a sheet-processing direction, the forward-most end of the folded sheet section is longer than the rear-most end of the folded sheet section. Thus, if the fold of the sheet section is at the bottom of the pocket, when viewing the ends of the folded sheet section in the pocket from above, the forward lap is higher than the rear lap.

In such a position, the folded sheet section can be opened if the forward, higher lap is secured by a device (applying a physical contact and/or air suction) and the pocket or folded sheet section is moved or tilted to allow gravity (possibly assisted with suction) to let the rear lap fall away from the forward lap. After the rear lap has fallen or is moved away from the forward lap, there exists an opening into which a second section can be inserted. Accordingly, a second section can be inserted into or nested within the first section. This combined section can then be inserted into a further section, and so on, to create a multiply nested set of sheets, typically, forming a common newspaper.

The securing device typically takes the form of a finger-shaped gripper. In the opening process, such a gripper is rotated or lowered onto the forward lap to secure the forward lap, and the forward sheet section, to a front wall of the pocket. Some examples of prior art gripper systems in such pockets include U.S. Pat. No. 4,723,770 to Seidel et al., U.S. Pat. No. 4,988,086 to Schlough, and U.S. Pat. No. 5,024,432 to Thünker et al. However, lap sizes are neither consistent nor equal. Therefore, there is a need to adjust such grippers in a vertical direction with respect to a pocket so that the forward lap is gripped in the most efficient place. Prior art pocket systems solve this positioning problem by vertically adjusting the lowermost surface of the pocket holding the folded sheet section. If such a surface is lowered, the folded section resting thereon is also lowered. Similarly, if the lowermost surface is raised, the folded section resting thereon is also raised. What is needed is more precise lap-gripping adjustment system that is independent of the lowermost surface of the pocket.

U.S. Pat. No. 5,911,416 to Klopfenstein describes a sheet material conveying apparatus with a plurality of pockets moveable around a track to accept sheet material from sheet material feeders. These pockets permit, for example, a first outer section of a newspaper to first be fed into the pockets by a first sheet material feeder, and then an inner newspaper section to be inserted between the folds of the first outer newspaper section. The Klopfenstein apparatus uses a lift cam 20 to move a semicircular actuator gear 150 to rotate a drive shaft 110 so as to set a height for pocket feet 90 disposed on racks 80. A pawl and ratchet mechanism prevents the pocket from opening. The sheet material can then be accepted and inserted into the pockets. To deliver the sheet material, a trip cam 22 can release the pawl and ratchet mechanism. Tracks 80 move to a lower position through a biasing spring, so that feet 90 release through operation of a driver cam 130. The sheet material in the pocket can, thus, move out of the pocket from the bottom to be further conveyed or to be stacked. The entirety of Klopfenstein is hereby incorporated by reference.

U.S. Pat. No. 5,251,888 to Eugster purports to describe pockets moveable along an endless path. Each pocket is provided with two vertically adjustable stops 14 mounted displaceably in a pocket carrier 8. A guide member 28 purportedly can be set to vertically adjust the stops 14 as the pockets are moved along the endless path.

Other examples of adjustment devices for the bottom of a pocket can be found in U.S. Pat. No. 3,891,202 to Kircher, U.S. Pat. No. 4,373,710 to Hansen et al., and U.S. Pat. No. 6,311,968 to Linder et al.

These prior art pocket systems do not provide an adjustment device for setting placement of grippers at the top of the pocket or at the gripper location itself.

SUMMARY OF THE INVENTION

It is accordingly an object of the invention to provide an adjustable gripping device for adjustable sheet-receiving pockets and method for adjusting sheet-receiving pockets that overcome the hereinafore-mentioned disadvantages of the heretofore-known devices and methods of this general type and that better separates the forward lap from the rearward lap by adjusting grippers in a vertical direction with respect to a pocket so that the forward lap is gripped in the most efficient place.

Commonly assigned U.S. patent application Ser. No. 09/662,277, entitled "SHEET MATERIAL CONVEYING APPARATUS WITH INDIVIDUALLY-ADJUSTABLE POCKETS" filed on Sep. 14, 2000, describes a plurality of manually-adjustable pockets, each having a setting device for adjusting a height of the pocket.

Commonly assigned U.S. patent application Ser. No. 09/702,012, entitled "SHEET MATERIAL CONVEYING APPARATUS WITH HEIGHT-ADJUSTABLE POCKETS"

filed on Oct. 30, 2000, describes a plurality of manually adjustable pockets, each having a setting device for adjusting a height of the pocket so as to define a set height.

Commonly assigned U.S. patent application Ser. No. 10/178,651, entitled "ADJUSTABLE GRIPPING DEVICE FOR ADJUSTABLE SHEET RECEIVING POCKETS AND METHOD FOR ADJUSTING SHEET RECEIVING POCKETS" and filed concurrently herewith, describes a different gripper adjusting system 70 having an adjustable gripper 71 with two main parts, a gripper body 72 and an adjustment device 73 including a pivot 75, a cam follower 77, and an adjustment body 79 in the form of a two-arm rocker. Depending on a placement setting of a vertically adjustable cam 26, the adjustment body 79 pivots and moves a nose 74 of gripper body 72 along the surface of upper front wall 52 away from or towards the uppermost edge of the rearward lap 63.

Commonly assigned U.S. patent application Ser. No. 10/178,642, entitled "LAP SEPARATOR FOR SHEET-RECEIVING POCKETS AND METHOD FOR SEPARATING LAPS IN SHEET-RECEIVING POCKETS" and filed concurrently herewith, describes a lap separator system 70 for extending a window of time for allowing grippers 53, 55 to engage a forward lap 61. The lap separating system 70 includes at least one lap separator 72 moveably disposed on a lap separator carrier system 74, preferably in the form of an endless belt that follows pockets 10, but moves at a different speed. Lap separator 72 contacts a rearward side of upper rear wall 54 and forces it against upper front wall 52, thereby clamping a folded section 6 therebetween. As lap separator 72 is traveling with but faster than pocket 10, it first lets go of upper rear wall 54, then of rearward lap 63, and, finally, of upper front wall 52 by dragging over the uppermost edge of each, similar to a fanning of a deck of cards.

A setting device of some of the commonly assigned applications is manually operated by an operator, who turns a knob gear and sets a lock ring for a desired pocket height. It may be desirable to provide a less time consuming, one-step setting device for each pocket.

Each of these commonly assigned applications is hereby incorporated by reference herein.

With the foregoing and other objects in view, there is provided, in accordance with the invention, an adjustable gripper system for releasably holding at least one sheet against a surface, including a rotatable gripper shaft having a shaft axis, at least one gripper connected to the gripper shaft and rotating with the gripper shaft about the shaft axis to selectively hold the sheet against the surface, a pivot shaft having a pivot axis, an adjustment body connected to the pivot shaft for pivoting the adjustment body about the pivot axis, the gripper shaft rotatably connected within the adjustment body, a cam follower to be actuated by a cam, the cam follower connected to the adjustment body for pivoting the adjustment body about the pivot axis, and the adjustment body displacing the gripper shaft about the pivot axis dependent upon a position of the cam to correspondingly displace the gripper along the surface.

In accordance with another feature of the invention, gripper is a plurality of grippers spaced apart from one another on the gripper shaft.

In accordance with a further feature of the invention, the gripper is releasably connected to the gripper shaft. Preferably, the gripper shaft is journaled in the adjustment body.

In accordance with an added feature of the invention, the adjustment body is a lever. Preferably, the lever is a rocker having two ends, a first of the ends is connected to the cam follower, and the gripper shaft is rotatably connected within a second of the ends.

In accordance with an additional feature of the invention, the cam follower is a wheel and an axle rotatably connecting the wheel to the second end.

In accordance with yet another feature of the invention, the gripper shaft is to be connected to a second cam for rotating the gripper shaft about the shaft axis.

With the objects of the invention in view, there is also provided an adjustable gripper system for releasably holding at least one sheet against a surface, including an adjustment body, at least one rotatable gripper rotatably connected to the adjustment body for selectively holding the sheet against the surface, and a cam follower to be actuated by a cam, the cam follower connected to the adjustment body and displacing the adjustment body dependent upon a position of the cam and correspondingly displacing the gripper along the surface.

With the objects of the invention in view, there is also provided a sheet-collating pocket, including a forward wall having an upper end portion, a rearward wall pivotably connected to the forward wall for moving towards and away from the forward wall, the rearward wall and the forward wall together defining an opening for receiving at least one sheet, and an adjustable gripper system for releasably holding the sheet against the forward wall, the gripper system disposed at the upper end portion and having an adjustment body, at least one rotatable gripper rotatably connected to the adjustment body for selectively holding the sheet against the forward wall, and a cam follower to be actuated by a cam, the cam follower connected to the adjustment body and displacing the adjustment body dependent upon a position of the cam and correspondingly displacing the gripper along the forward wall.

In accordance with yet a further feature of the invention, the pocket travels in a given direction, and the forward wall is disposed downstream of the rearward wall with respect to the given direction.

In accordance with yet an added feature of the invention, the upper end portion is an upper third, fourth, or fifth of the forward wall. Preferably, the forward wall has a top and the gripper system is disposed substantially at the top.

With the objects of the invention in view, there is also provided a sheet-collating pocket, including a forward wall having an upper end portion, a rearward wall pivotably connected to the forward wall for moving towards and away from the forward wall, the rearward wall and the forward wall together defining an opening for receiving at least one sheet, and an adjustable gripper system for releasably holding the sheet against the forward wall, the gripper system disposed at the upper end portion and having a rotatable gripper shaft with a shaft axis, at least one gripper connected to the gripper shaft and rotating with the gripper shaft about the shaft axis to selectively hold the sheet against the forward wall, a pivot shaft having a pivot axis, an adjustment body connected to the pivot shaft for pivoting the adjustment body about the pivot axis, the gripper shaft rotatably connected within the adjustment body, a cam follower to be actuated by a cam, the cam follower connected to the adjustment body for pivoting the adjustment body about the pivot axis, and the adjustment body displacing the gripper shaft about the pivot axis dependent upon a position of the cam to correspondingly displace the gripper along the forward wall.

With the objects of the invention in view, in a sheet-collating pocket having a top, a forward wall, and a rearward wall pivotably connected to the forward wall, the rearward and forward walls together defining an opening for receiving at least one sheet from the top, there is also provided an adjustable gripping system for setting placement of grippers at the top of the pocket, the gripping system including an adjustment body, at least one rotatable gripper rotatably connected to the adjustment body for selectively holding the sheet against the forward wall, and a cam follower to be actuated by a cam, the cam follower connected to the adjustment body and displacing the adjustment body dependent upon a position of the cam and correspondingly displacing the gripper along the forward wall.

With the objects of the invention in view, in a sheet-collating pocket having a top, a forward wall, and a rearward wall pivotably connected to the forward wall, the rearward and forward walls together defining an opening for receiving at least one sheet from the top, there is also provided an adjustable gripping system for setting placement of grippers at the top of the pocket, the gripping system including a rotatable gripper shaft having a shaft axis, at least one gripper connected to the gripper shaft and rotating with the gripper shaft about the shaft axis to selectively hold the sheet against the forward wall, a pivot shaft having a pivot axis, an adjustment body connected to the pivot shaft for pivoting the adjustment body about the pivot axis, the gripper shaft rotatably connected within the adjustment body, a cam follower to be actuated by a cam, the cam follower connected to the adjustment body for pivoting the adjustment body about the pivot axis, and the adjustment body displacing the gripper shaft about the pivot axis dependent upon a position of the cam to correspondingly displace the gripper along the forward wall.

With the objects of the invention in view, there is also provided a sheet-collating machine, including a conveyor traveling along a transport direction, at least one sheet feeding device disposed at the conveyor for feeding at least one sheet towards the conveyor, a plurality of sheet-collating pockets, each of the pockets connected to the conveyor, receiving the sheet from the sheet feeding device, and transporting the sheet along at least a portion of the conveyor in the transport direction, an adjustable cam having an adjustment device displacing the cam in different positions with respect to the pockets, the cam disposed at the conveyor and selectively contacting each of the pockets as each pocket respectively passes thereby, and each of the pockets having a forward wall with an upper end portion, a rearward wall pivotably connected to the forward wall, the rearward wall and the forward wall together defining an opening for receiving at least one sheet, and an adjustable gripper system for releasably holding the sheet against the forward wall, the gripper system disposed at the upper end portion and having an adjustment body, at least one rotatable gripper rotatably connected to the adjustment body for selectively holding the sheet against the forward wall, and a cam follower actuated by the cam, the cam follower connected to the adjustment body and displacing the adjustment body dependent upon a position of the cam and correspondingly displacing the gripper along the forward wall.

With the objects of the invention in view, there is also provided a sheet-collating machine, including a conveyor traveling along a transport direction, at least one sheet feeding device disposed at the conveyor for feeding at least one sheet towards the conveyor, a plurality of sheet-collating pockets, each of the pockets connected to the conveyor, receiving the sheet from the sheet feeding device, and transporting the sheet along at least a portion of the conveyor in the transport direction, an adjustable cam having an adjustment device displacing the cam in different positions with respect to the pockets, the cam disposed at the conveyor and selectively contacting each of the pockets as each pocket respectively passes thereby, and each of the pockets having a forward wall with an upper end portion, a rearward wall pivotably connected to the forward wall, the rearward wall and the forward wall together defining an opening for receiving at least one sheet, and an adjustable gripper system for releasably holding the sheet against the forward wall, the gripper system disposed at the upper end portion and having a rotatable gripper shaft having a shaft axis, at least one gripper connected to the gripper shaft and rotating with the gripper shaft about the shaft axis to selectively hold the sheet against the forward wall, a pivot shaft having a pivot axis, an adjustment body connected to the pivot shaft for pivoting the adjustment body about the pivot axis, the gripper shaft rotatably connected within the adjustment body, a cam follower actuated by the cam, the cam follower connected to the adjustment body for pivoting the adjustment body about the pivot axis, and the adjustment body displacing the gripper shaft about the pivot axis dependent upon a position of the cam to correspondingly displace the gripper along the forward wall.

With the objects of the invention in view, there is also provided a method for adjustably gripping at least one sheet within a sheet-receiving pocket of a sheet-collating device, including the steps of conveying sheet-receiving pockets along a transport path, each of the pockets having forward and rearward walls pivotably connected to one another, the forward wall having a top portion, and at least one adjustable gripper having a holding portion for holding at least a portion of a sheet deposited in a respective one of the pockets, the gripper disposed at the top portion, selectively placing a cam into a position in the transport path of the pockets, contacting each of the pockets with the cam to selectively move the holding portion of the gripper dependent upon the selected position of the cam, and while retaining contact between the cam and the pocket opening the forward and rearward walls of each of the pockets to create a sheet-receiving opening, conveying the pockets past a sheet-feeding device, and feeding the sheet into the sheet-receiving opening from the sheet feeding device to place the portion of the sheet against the forward wall, and securely gripping at least the portion of the sheet against the forward wall with the holding portion of the gripper.

With the objects of the invention in view, there is also provided a method for adjusting grippers of sheet-receiving pockets, including the steps of providing sheet-receiving pockets to be conveyed in a transport path, each pocket having a top portion and at least one adjustable gripper having a holding portion for holding at least a portion of a sheet deposited in the pocket, the gripper disposed at the top portion, and positioning an adjustable cam in the transport path of the pockets to contact each of the pockets and selectively displace the holding portion of the gripper dependent upon a set position of the cam such that the portion of the sheet is securely gripped within the pocket with the holding portion of the gripper while contact exists between the cam and the pocket.

In accordance with a concomitant mode of the invention, the gripped sheet is transported in the pocket along at least a portion of the conveyor.

The present invention permits the grippers to be set to a set height while moving and to operate for a relevant distance at the set height. To change a gripper height, a movable setting cam is set for a new height and may also include a lock engagement device. The present invention provides a simple method and device for resetting gripper height and allows for manual re-setting of the gripper height.

"Rod" as defined herein can be any elongated structure. "Slide gear" as defined herein specifically includes any type of slidable interlocking structure, and may include a gear with an exterior star gearing, a single key or tooth exterior structure, or any other structure with which a ring gear may be fixed rotationally and with which a lock ring may be selectively fixed or free to rotate, include one having a ball-detent mechanism.

Other features that are considered as characteristic for the invention are set forth in the appended claims.

Although the invention is illustrated and described herein as embodied in an adjustable gripping device for adjustable sheet-receiving pockets and method for adjusting sheet-receiving pockets, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
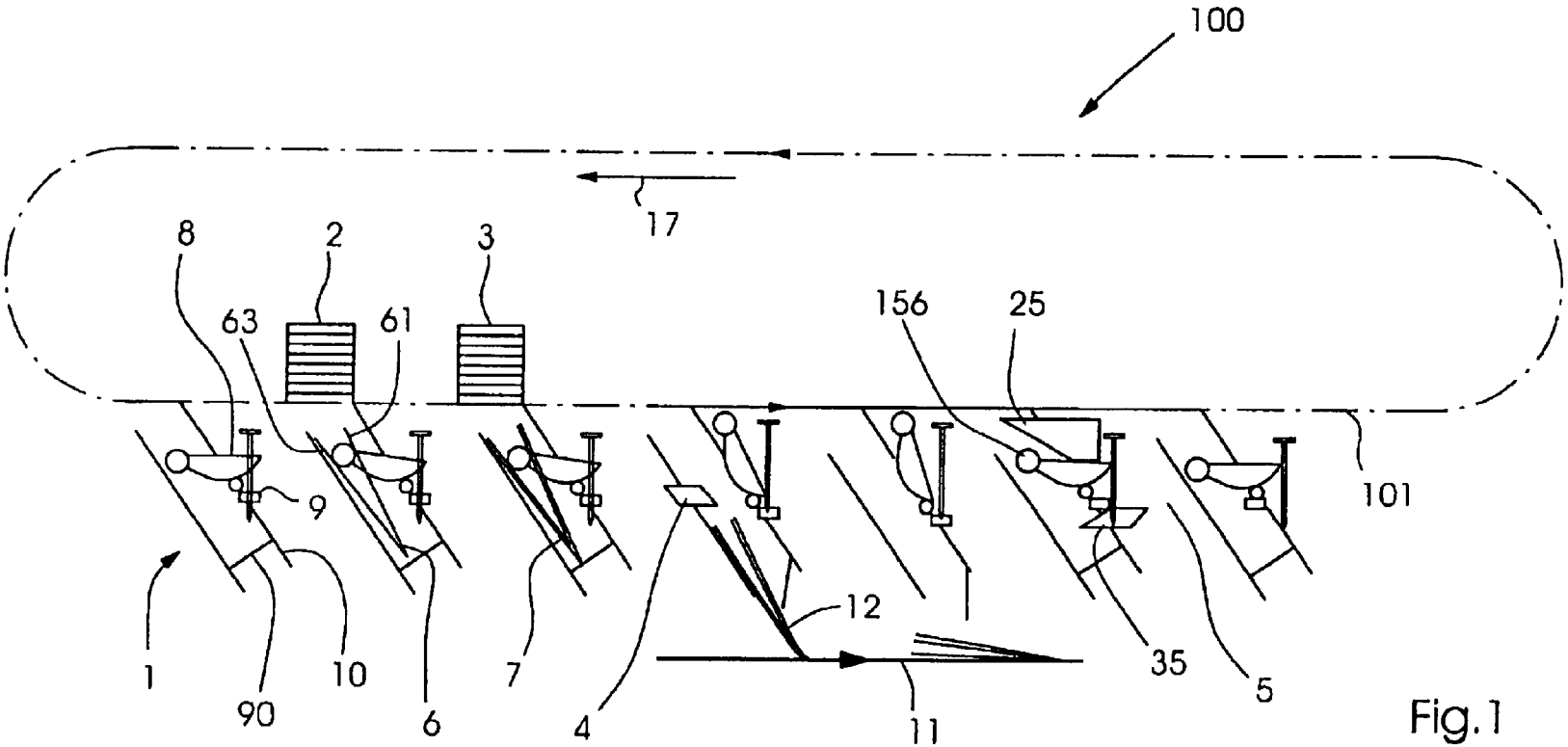
FIG. 1 is a diagrammatic perspective view of a sheet material conveying apparatus according to the invention.

Referring now to the figures of the drawings in detail and first, particularly to FIG. 1 thereof, there is shown a diagrammatic representation of a sheet material conveying apparatus 100 having an endless track 101 for transporting a plurality of pockets 10 in transport direction 17. Each pocket 10 includes moveable fingers 90 for defining a pocket height, an individual height setting mechanism 8, and a releasable lock mechanism 9 for height setting mechanism 8.

At a setting area 1, each pocket 10 can be set manually by setting mechanism 8 to move fingers 90 to at least one of two desired heights, for example, a setting for receiving 10½-inch folded products. Pockets 10 are stationary during setting, and the setting can occur outside setting area 1 as well, for example, by an operator moving about track 101.

Alternatively, pockets 10 can be moved to setting area 1, the apparatus can be stopped, and each pocket can be set. An automated robot for interacting with setting mechanism 8 also could be located at setting area 1 to move each pocket 10 to the proper height, as a pocket 10 is moved to and stopped at setting area 1.

After a pocket is set to a desired height, setting mechanism 8 is then locked in place by lock mechanism 9 so that the pocket height is set. After all pockets 10 are set, they are moved to pass beneath a first sheet material feed station 2 where, for example, a folded cover section 6 of a newspaper or other printed product, also referred to as a jacket, is delivered into pocket 10. At a second and optional sheet material feed station 3, a second section 7 may be inserted between forward and rear portions of cover section 6 to form a final printed product 12. This process can be repeated for any number of feed stations 2, 3 to create a final product 12 having many nested sections 6, 7.

After receiving sections 6, 7, pockets 10 can then pass a release station 4, which releases lock mechanism 9. Setting mechanism 8, which is, preferably, spring-loaded, then releases fingers 90 so that the bottom of pocket 10 opens, and finished products 12 are delivered, for example, to a conveyor belt 11.

As pockets 10 continue past release station 4, pockets 10 pass through a reset station 5, which can include a movable incline reset ramp 25 for interacting with a reset cam follower 156 (see FIG. 3) of setting mechanism 8 and a lock engagement device 35 for locking lock mechanism 9. Pockets 10, which are preferably all set to a common height, are then reset to the common height by reset ramp 25, and locked into place by lock engagement device 35 engaging lock mechanism 9.

Figure 2A:
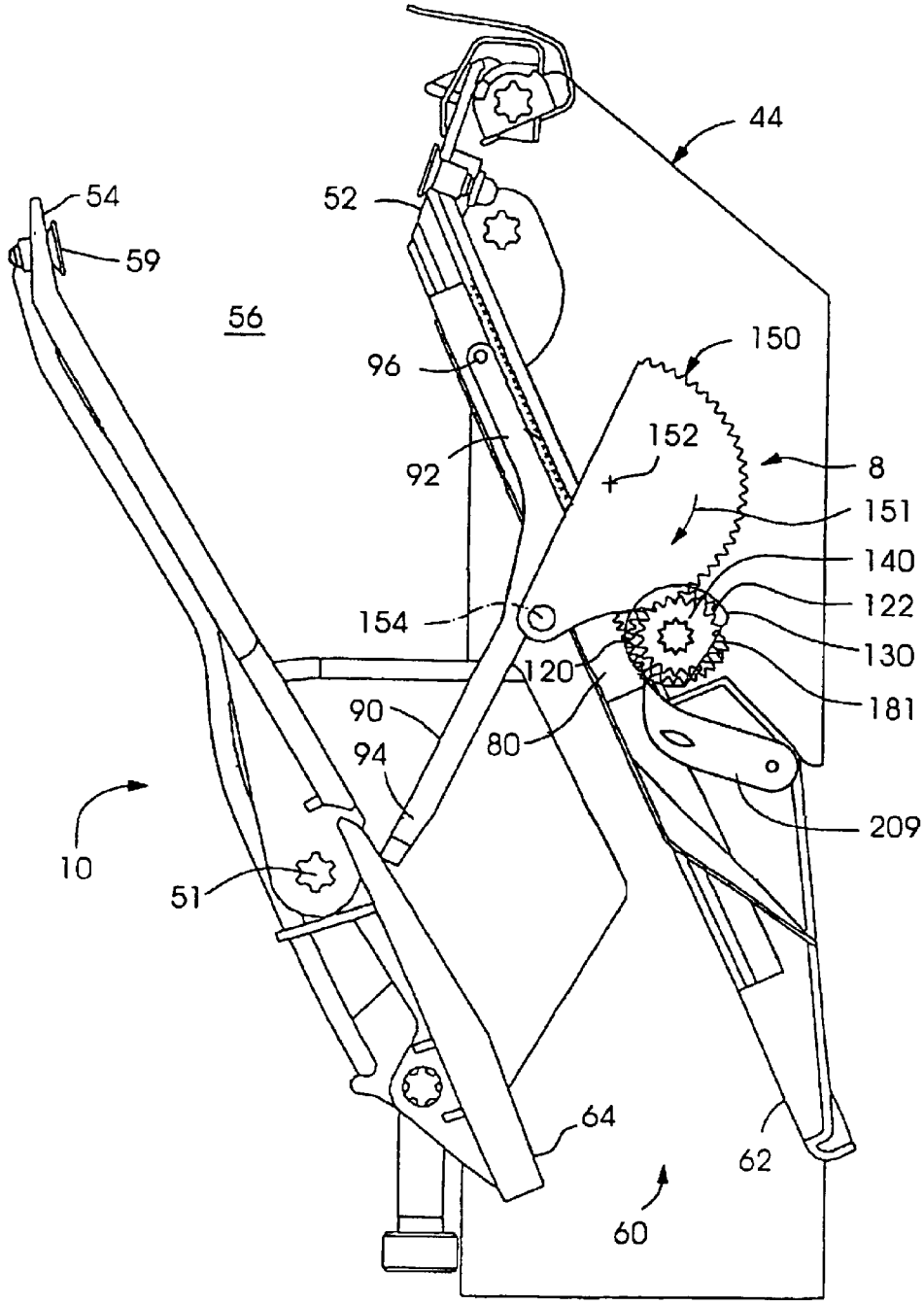
FIG. 2A is a side view of a pocket according to the invention with certain elements omitted for clarity.
Figure 3:
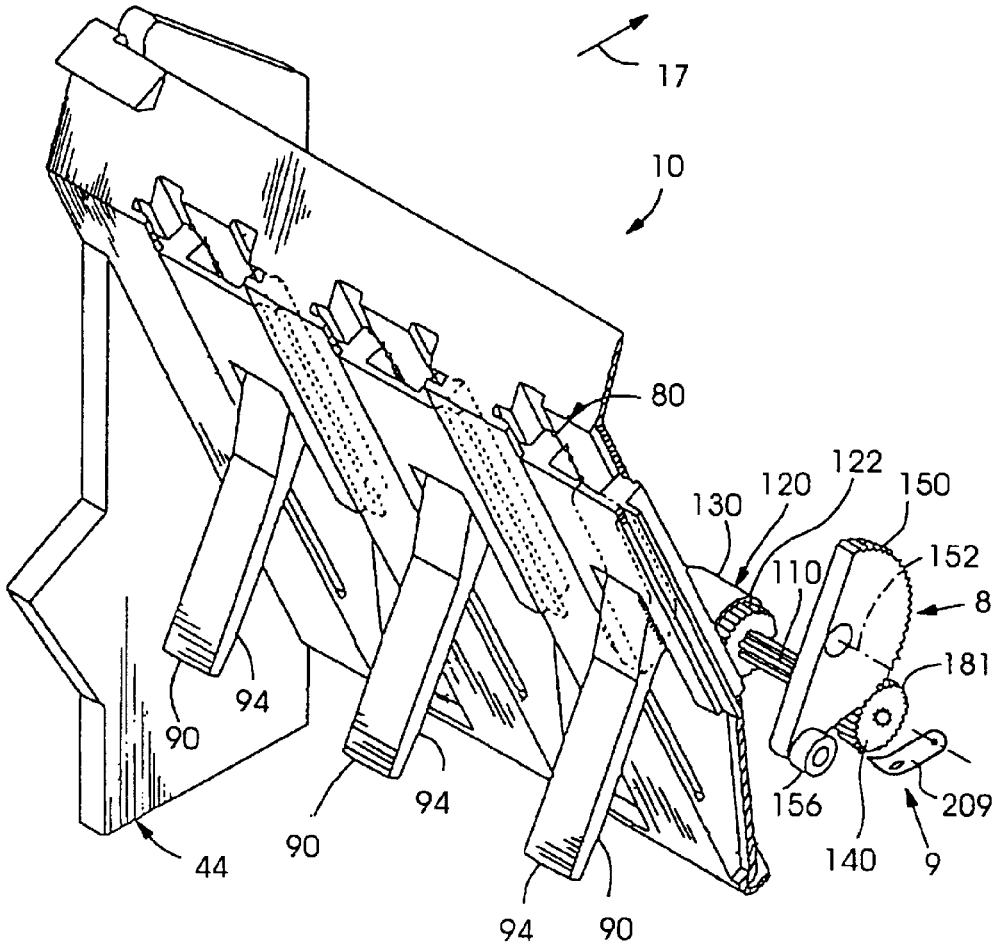
FIG. 3 is a fragmentary perspective view of the pocket of FIG. 2A with certain elements omitted for clarity.
Figure 4:
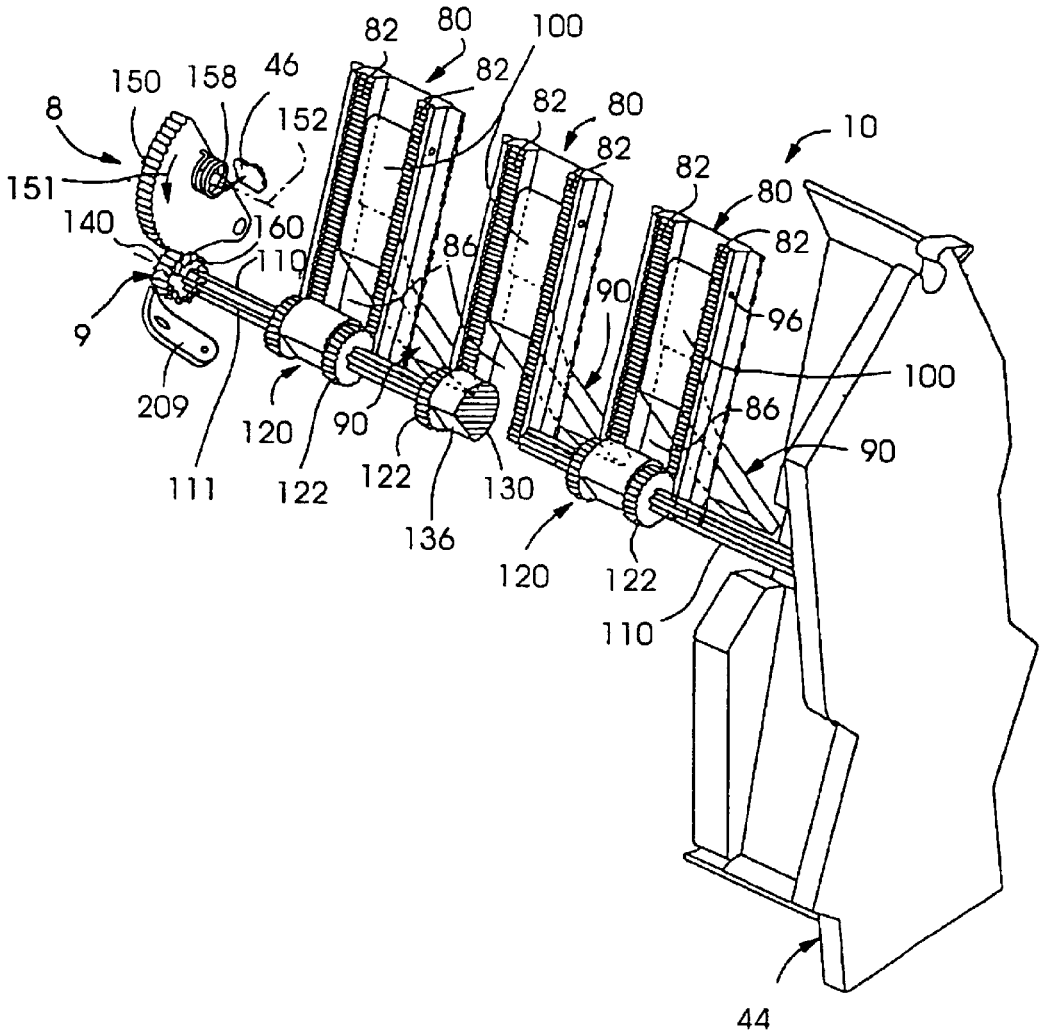
FIG. 4 is a different, fragmentary perspective view of the pocket of FIGS. 3.

FIGS. 2A, 3, and 4 show more details of pocket 10.

Pocket 10 has an upper rear wall 54 and an upper front wall 52, in between which is an opening 56 for accepting sheet material, for example, cover section 6. Pocket 10 also has a side wall 44. Pocket 10 also may have a lower rear wall 64 and a lower front wall 62.

Figure 2B:
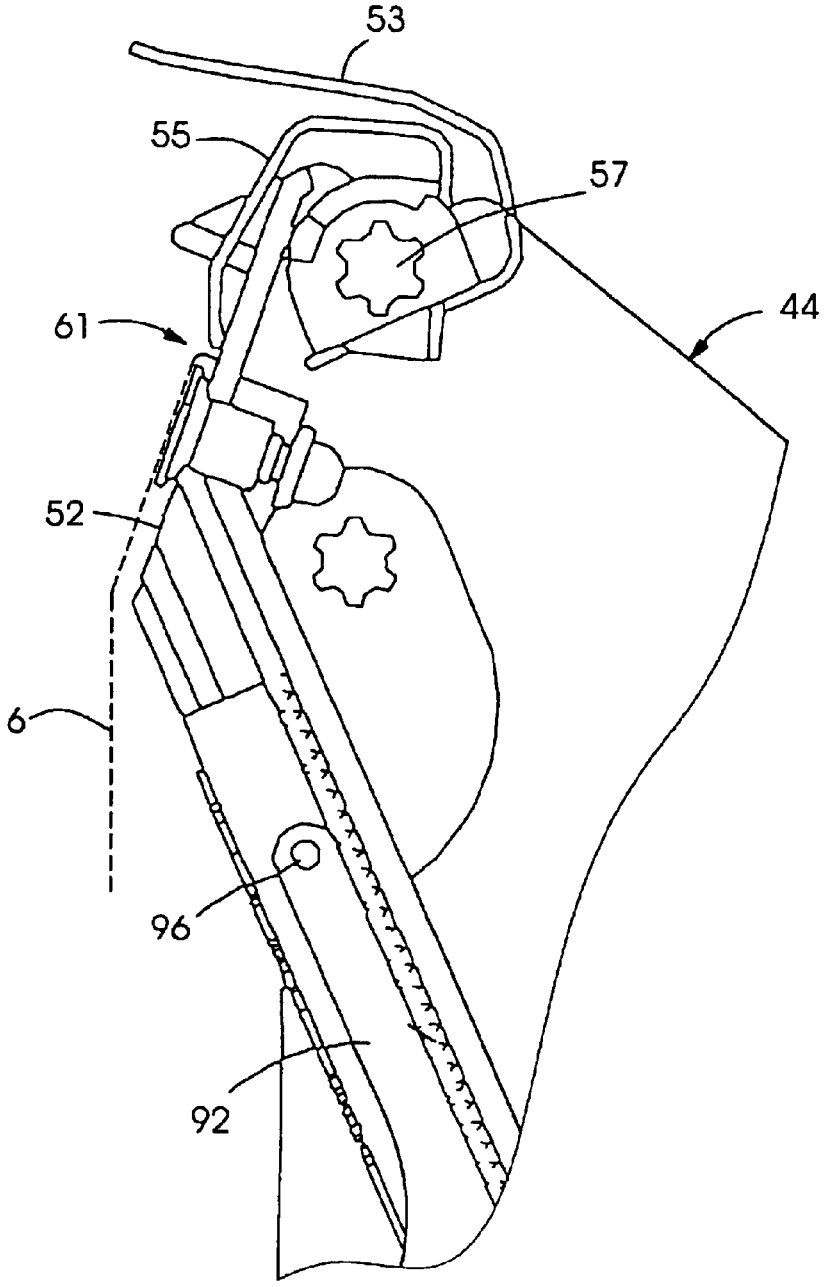
FIG. 2B is a side view of an enlarged detail of a gripper of the pocket of FIG. 2A.

FIG. 2B is an enlarged view of the upper portion of pocket 10 illustrated in FIG. 2A. FIG. 2B shows the area where a forward lap 61 of a cover section 6 is held. To hold cover section 6 in place, a set of grippers 53, 55 are located at the top of upper front wall 52. Grippers 53, 55 are shown coaxially disposed on a single shaft 57, albeit in different rotational positions. However, alternatively, different sets of grippers can be disposed on different shafts, each being independently controlled. For example, grippers of one set can be longer than grippers of another set. Also, grippers 53, 55 are shown at the top of upper front wall 52. However, grippers 53, 55 can be located at the upper third, fourth, or fifth of upper front wall 52, depending upon the distance between the top of section 6 and a top of upper front wall 52.

A non-illustrated control device pivots shaft 57 holding grippers 53, 55 between an engaged position and a disengaged position. In FIG. 2B, one gripper 53 is shown in the disengaged position and the other gripper 55 is shown in the engaged position. In the engaged position, gripper 55 holds forward lap 61 of cover section 6 so that it is fixed with respect to upper front wall 52. A cover section 6 being so held is shown diagrammatically in FIG. 2B with a dashed line.

When cover section 6 is first deposited in opening 56, the bottom (lowermost) edge of cover section 6 rests at the junction between fingers 90 and upper rear wall 54. In the open position of pocket 10 shown in FIG. 2A, gravity causes cover section 6 to rest entirely against upper rear wall 54. To grip cover section 6 with grippers 53, 55, upper rear wall 54 is pivoted about axis 51 to contact upper front wall 52. Alternatively and/or additionally, the entire rear wall 54, 64 can be displaced towards front wall 52, 62. When cover section 6 rests against upper front wall 52, grippers 53, 55 can be rotated into the engaged position and hold cover section 6 in place against upper front wall 52. If grippers 53, 55 are adjusted so that they extend no further than the top edge of rearward lap 63 of cover section 6, then grippers 53, 55 only grip forward lap 61 of cover section 6. After engaging forward lap 61, when upper rear wall 54 is moved back to the position shown in FIG. 2A, forward lap 61 is held against upper front wall 52 and gravity carries rearward lap 63 of cover section 6 along with upper rear wall 54, thus creating an opening between forward lap 61 and rearward lap 63 for receiving another section 7 therein, for example, from second sheet material feed station 3.

Slidable with respect to upper front wall 52 is a rack 80, on which fingers 90 are supported. Fingers 90 are supported on rack 80 by a pivot 96 attached to a first section 92 of finger 90. A second section 94 of finger 90 can define a pocket bottom when fingers 90 are in a closed position (as illustrated in FIG. 2A). As most clearly shown in FIG. 4, rack 80 includes teeth 82 that interact with a gear 122 of a pinion 120 (FIGS. 3 and 4), which also includes a release cam 130. Pinions 120 are located on a shaft 110 rotatably supported in wall 44 and wall 46 (only partially shown in FIG. 4).

At wall 46, an end 111 of shaft 110 passes through a setting ring gear 140, of which only a first part is shown in FIG. 3. Ring gear 140 has an interior surface that ensures rotation of ring gear 140 in a fixed relationship with a slide gear 180 (FIG. 5) that is in a fixed rotational relationship with shaft 110. Slide gear 180, however, can slide axially with respect to shaft 110 for selective interlocking with lock ring 160 (interior to gear 140 and visible in FIG. 6) that forms part of lock mechanism 9. Lock mechanism 9 also includes a pawl 209 for interacting with a single ratchet 164 on the exterior of ring 160. Ring gear 140 is shown in FIGS. 2A, 3, and 4 only in part, with a second outer gear section 182 (FIGS. 5 and 6) for interacting with a non-illustrated setting rod. The details of slide gear 180 and its interaction with ring gear 140 and lock ring 160 will be described in more detail with respect to FIGS. 5 and 6.

FIG. 3 shows how fingers 90 extend through the front wall. Release cam 130 can interact with a release surface 100 (FIG. 4) of finger 90 located in an opening 86 between teeth 82 when fingers 90 are fully lowered, so that fingers 90 rotate away from rear wall 54, 64 and release any products in pocket 10. Release of fingers 90 is similar to the release of the feet in U.S. Pat. No. 5,911,416 to Klopfenstein, which has been incorporated herein by reference.

FIG. 2A shows ring gear 140 interacting with a semicircular setting gear 150. On one side of semicircular gear 150 is a reset cam follower 156 held rotationally at an axis 154. Setting gear 150 pivots about an axis 152.

As shown in FIG. 4, semicircular gear 150 is attached to a spring 158 to spring-load gear 150 in a direction 151, as also shown in FIG. 2A.

Figure 5:
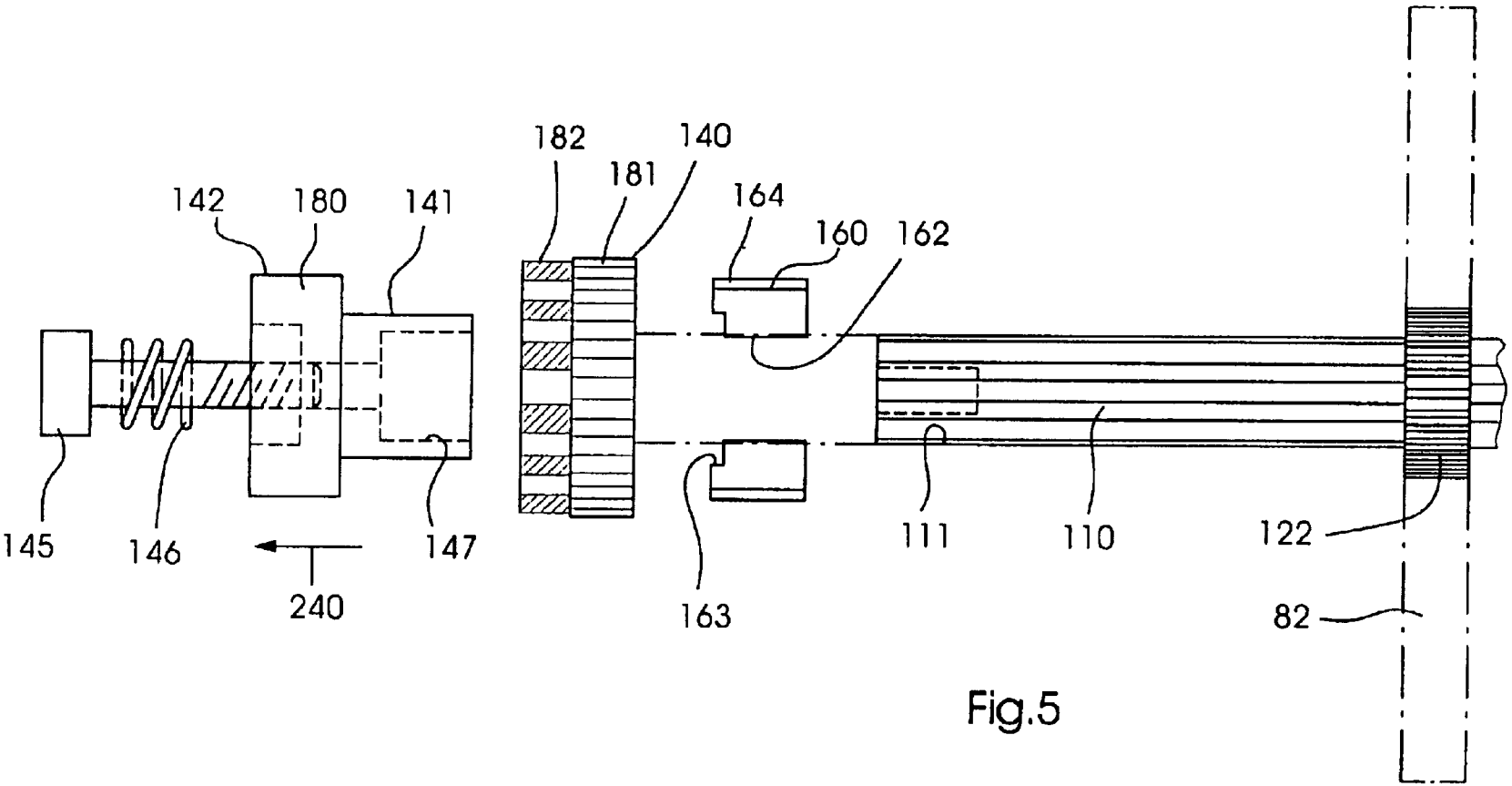
FIG. 5 is a fragmentary, partially exploded, cross-sectional view of a setting device for setting a finger height according to the invention.
Figure 6:
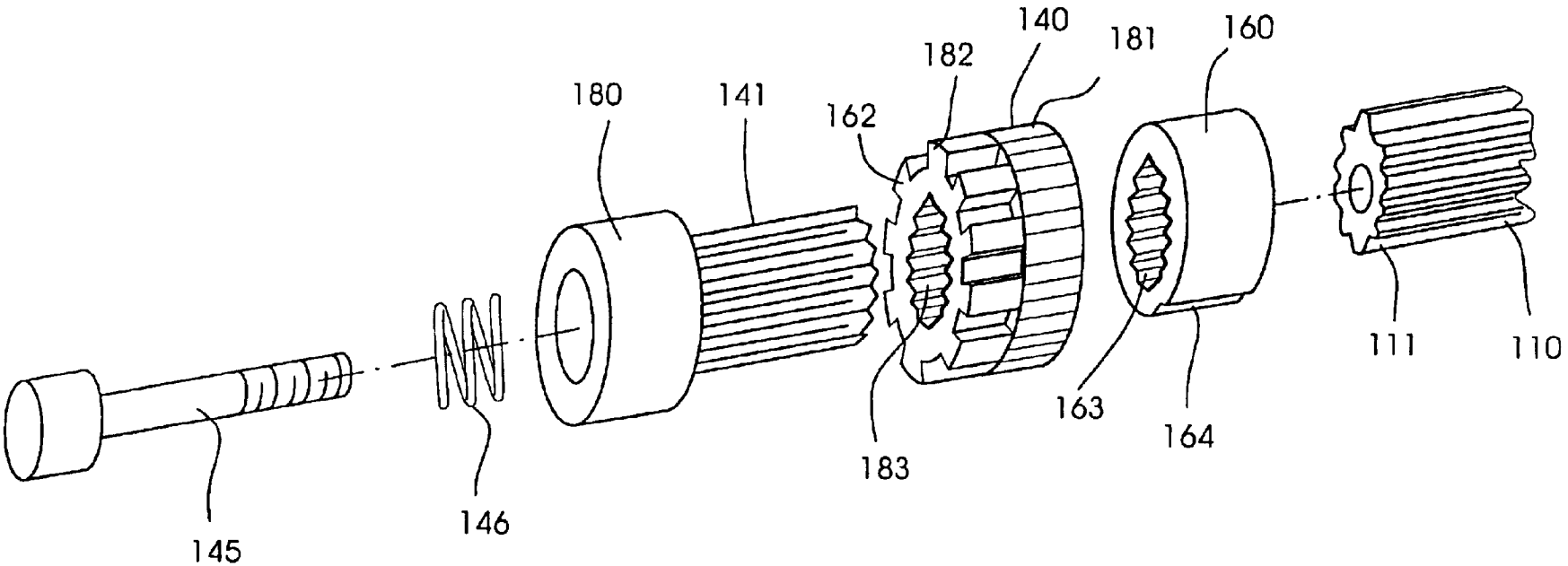
FIG. 6 is a fragmentary, exploded, perspective view of the setting device of FIG. 5.

FIG. 5 shows an exploded view of certain details of the setting mechanism. End 111 of shaft 110 fits, passing through interior holes in ring gear 140 and lock ring 160, into an interiorly toothed hole 147 of slide gear 180. End 111 is fixed to a screw 145 that abuts slide gear 180 through a spring 146. Thus, slide gear 180 can be moved against the force of spring 146 in the direction of arrow 240 so as to slide axially with respect to shaft 110, however always remaining rotationally fixed with shaft 110.

Slide gear 180 has exterior star gearing 141 that matches interior star gearing 183 of ring gear 140. Slide gear 180 and ring gear 140 thus rotate together at all times. Interior to slide gear 180 and ring gear 140 is lock ring 160, which selectively engages, through an interior star gear 163, exterior star gearing 141 of slide gear 180 when slide gear 180 is not moved axially against the spring force of spring 146.

When moved axially against the spring force in direction 240 (see FIG. 5), slide gear 180 releases from lock ring 160, which then is held only by pawl 209 but is freely rotatable with respect to shaft 110 due to a smooth inner surface section 162 that rests on shaft 110.

Slide gear 180 has a raised portion 142 for interacting with a disengaging device of a non-illustrated setting rod to permit slide gear 180 to be moved against the spring force of spring 146.

Ring gear 140 has external gear teeth 181 for interacting with semicircular gear 150 (FIG. 2A), as well as external gear teeth of second outer gear section 182 for interacting with the setting rod.

Figure 7:
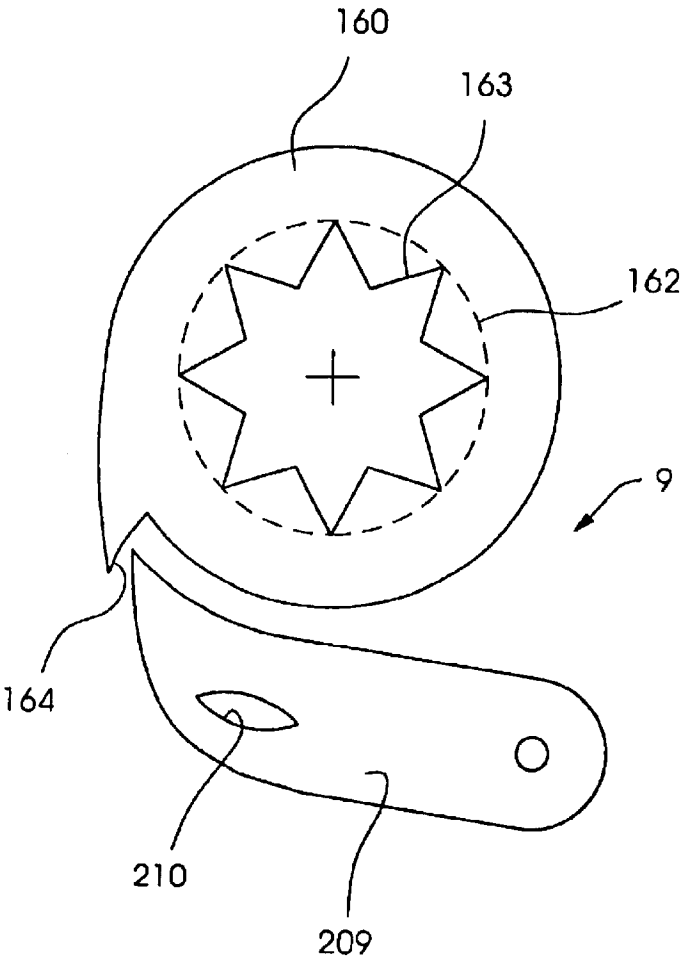
FIG. 7 is an enlarged side view of a detail of the setting device of FIG. 5.

Lock ring 160 has a single ratchet 164 on an external surface, which interacts with pawl 209, as shown in FIG. 7. An extension 210 extends outwardly from pawl 209, for permitting pawl 209 to move between an upward and a downward position. Pawl 209 may be spring-loaded to favor one position, or to click into both positions.

As stated above, after a pocket 10 is set to a desired height, setting mechanism 8 is then locked in place by lock mechanism 9 so that the pocket height is set. After all pockets 10 are set, they are moved to pass beneath at least one sheet material feed station 2, 3 where, for example, sections 6, 7 of a newspaper or other printed product are delivered into pocket 10.

Once pocket 10 is set to a desired height, it typically cannot be adjusted to account for variations in the size of sections 6, 7 being placed therein. Prior art devices have been created to adjust for such variations by only adjusting the level or location of the bottom of the pocket. Thereby, raising or lowering section 6, 7 placed therein from below. However, no prior art device has used an adjustment of grippers 53, 55 to compensate for section 6, 7 size variation.

As set forth above, up until the invention, there was a difficulty associated with separating forward lap 61 of a first section 6 from rearward lap 63 to create a pocket therebetween into which second section 7 can be inserted or nested.

The invention adds a new adjustment mechanism to grippers 53, 55.

Figure 8:
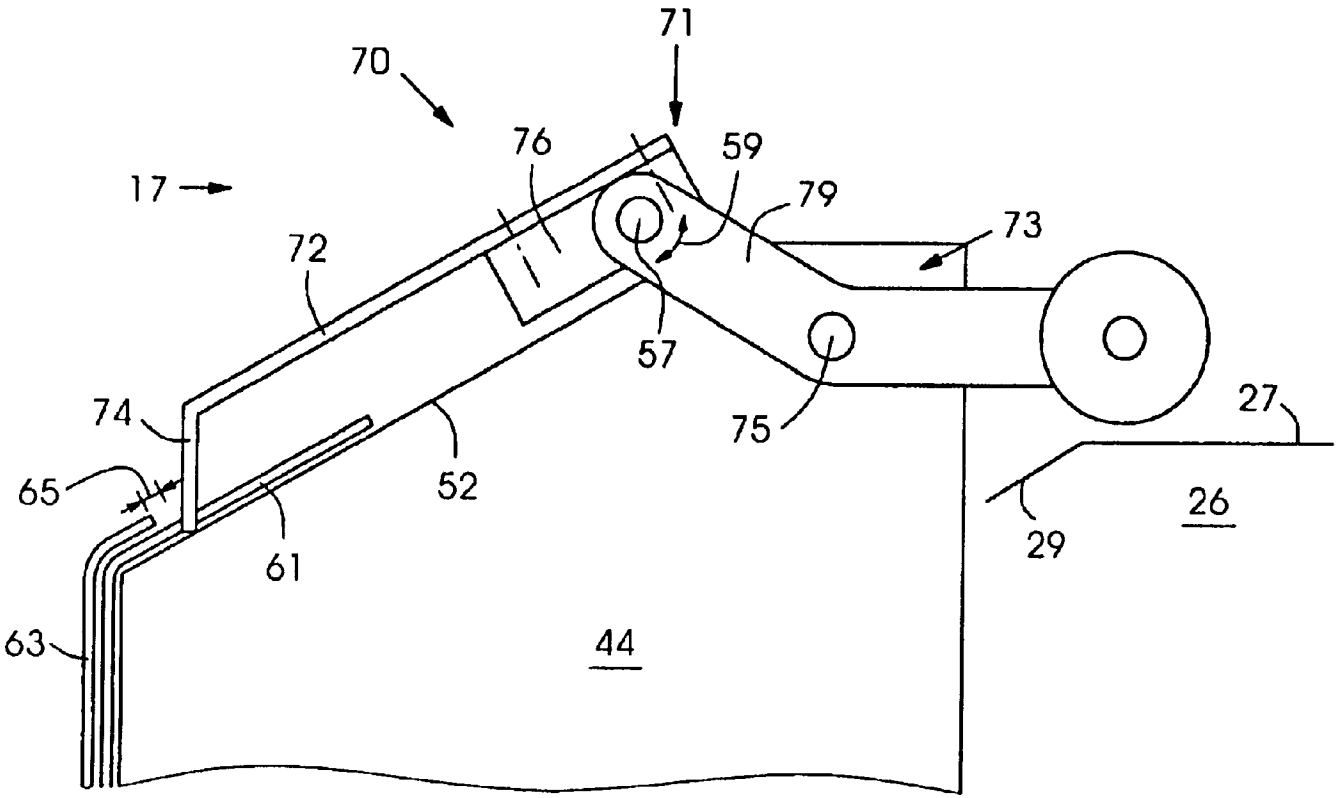
FIG. 8 is a diagrammatic, fragmentary, cross-sectional view of a gripper system according to the invention.
Figure 9:
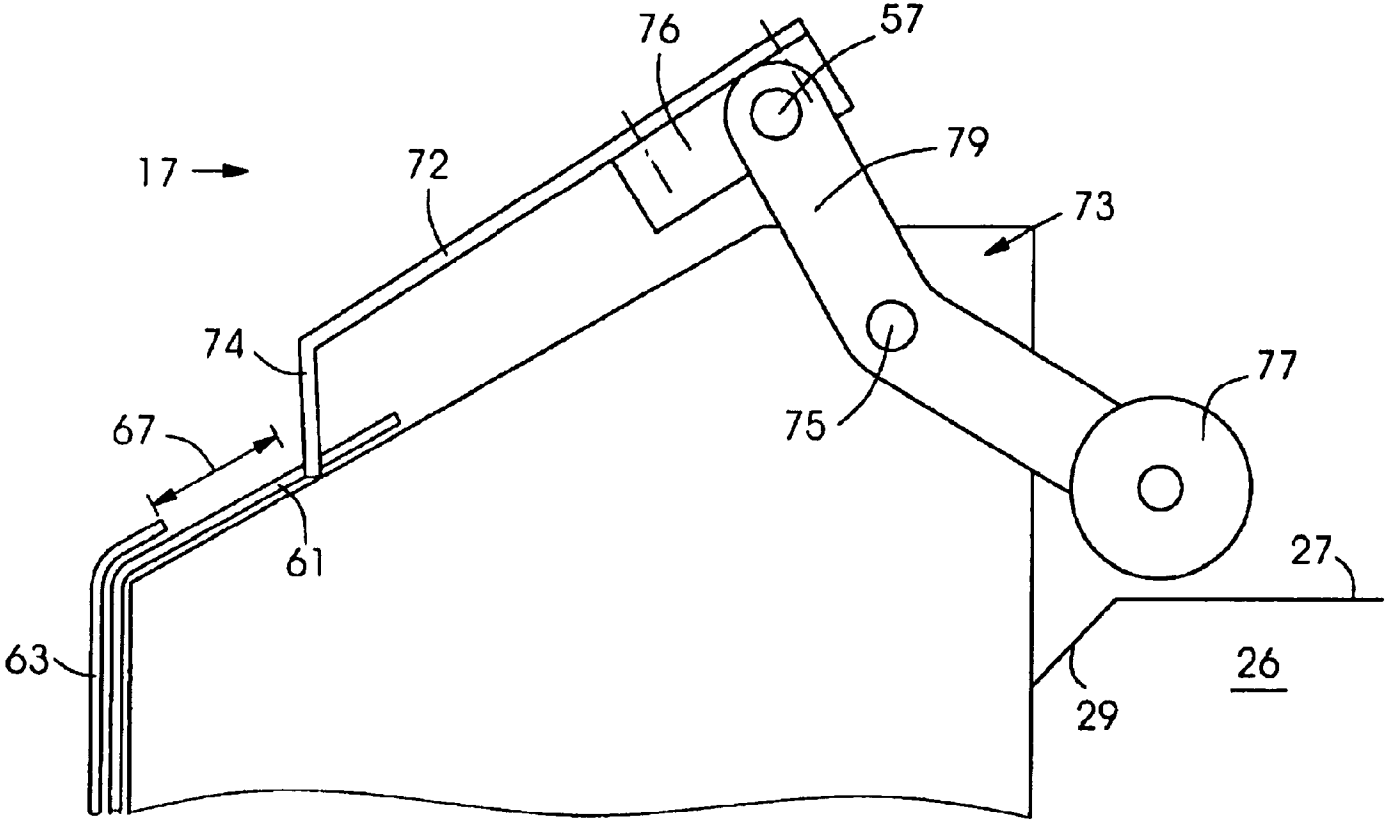
FIG. 9 is a diagrammatic, fragmentary, cross-sectional view of another position of the gripper system of FIG. 8.
Figure 10:
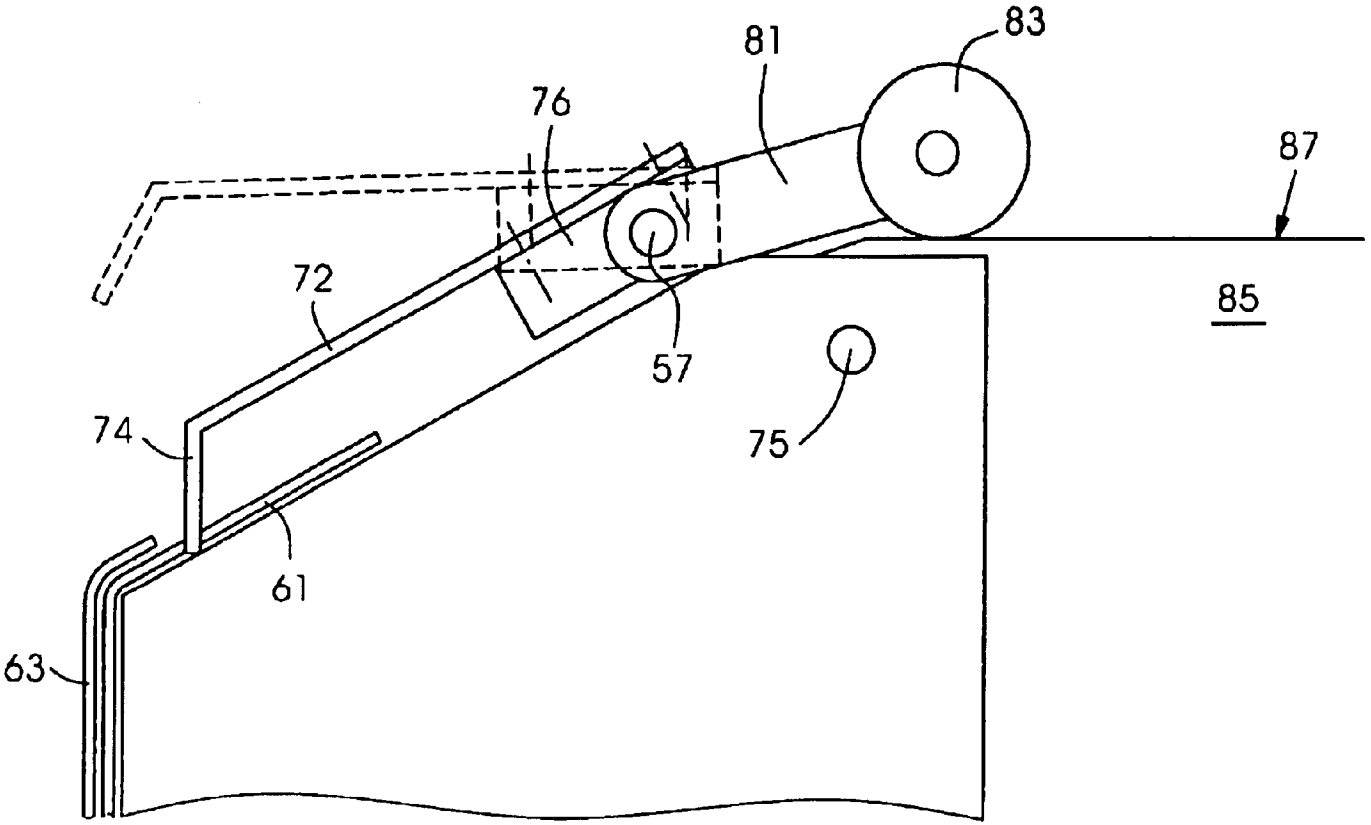
FIG. 10 is a diagrammatic, fragmentary, cross-sectional view of another position of the gripper system of FIG. 8.

FIGS. 8, 9, and 10 diagrammatically illustrate a gripper adjusting system 70. A single adjustable gripper 71 of system 70 is depicted in FIGS. 8 to 10 for the sake of clarity. Nonetheless, system 70 can be expanded to many or all of the grippers used to grip forward lap 61 in pocket 10. Single grippers 71 can be independently adjustable. Alternatively, or additionally, one gripper 71 can be adjustable but fixedly connected to one or more other grippers so that the other grippers follow any adjusting movement of the one adjustable gripper 71. Other equivalent embodiments of grippers are also possible.

Adjustable gripper 71 has two main parts, a gripper body 72 and an adjustment device 73.

Gripper body 72 has a nose 74 and a fastening portion 76. Nose 74 directly contacts and holds forward lap 61 of a section 6, or, if desired, holds the entire section 6, 61, 63. Gripper body 72 is, preferably fixedly but adjustably, attached to gripper shaft 57 (diagrammatically illustrated in FIGS. 2A and 2B) through fastening portion 76. Thus, when shaft 57 rotates about its axis 58 in either rotation direction 59, gripper body 72 is rotated as well, and nose 74 either lifts away from upper front wall 52 to let go of or make room to grasp forward lap 61 or moves towards upper front wall 52 to grasp forward lap 61 of section 6. Fastening portion 76 can take any form that connects gripper body 72 to gripper shaft 57. Preferably, fastening portion 76 releasably clamps to shaft 57 such that, when released, at least to a small extent, fastening portion 76 can rotate around shaft 57 for manual alignment and adjustment.

A preferred embodiment of adjustment device 73 includes a pivot 75, a cam follower 77, and an adjustment body 79 in the form of a two-arm rocker, a first rocker arm connecting gripper shaft 57 to pivot 75, and a second rocker arm connecting pivot 75 to cam follower 77. Preferably, cam follower 77 is disposed at a distal end of the second rocker arm.

FIGS. 8 and 9 illustrate how adjustment device 73 works.

A vertically adjustable adjustment cam 26 is placed in the path of pockets 10 as they travel in transport direction 17. Adjustment cam 26 is placed in a position similar to incline reset ramp 25, in that, a portion of pocket 10 must contact adjustment cam 26 as the portion passes thereby. Adjustment cam 26 can be set to any vertical distance with respect to adjustment device 73. As a pocket 10, including gripper adjusting system 70, approaches and passes adjustment cam 26, cam follower 77 first contacts ramp 29 and then rolls up and off ramp 29 onto an upper surface 27 of adjustment cam 26. The movement of cam follower 77 with respect to pivot 75 has a specific affect upon gripper body 72—the second rocker arm of adjustment body 79 moves up or down dependent upon the position of adjustment cam 26, thus moving gripper shaft 57 as well. Because shaft 57 is fixedly connected to gripper body 72, gripper body 72 is likewise moved, causing nose 74 to move along the surface of upper front wall 52 away from or towards the uppermost edge of rearward lap 63. This movement is dependent upon the placement of adjustment cam 26.

FIG. 8 illustrates adjustment cam 26 in a raised position with respect to pivot 75. Accordingly, gripper shaft 57 is in a lowered position with respect to pivot 75. A lower position of shaft 57 with respect to adjustment cam 26 means that gripper body 72, and, thus, nose 74, is relatively close to the uppermost edge of rearward lap 63 at a distance 65. It is possible, due to a variation in size of rearward lap 63, that nose 74 actually contacts rearward lap 63 (a condition not illustrated) and prevents rearward lap 63 from falling away from forward lap 61 to create the pocket for receiving an inserted section 7. Typically, a printing press operator needs to prevent this undesired condition. However, if desired, the invention permits lowering of gripper shaft 57 sufficient to intentionally place nose 74 over rearward lap 63.

An operator can use the invention and prevent this undesired condition by lowering adjustment cam 26 such that nose 74 no longer contacts rearward lap 63. FIG. 9 illustrates adjustment cam 26 in a lowered position with respect to pivot 75. A higher position of shaft 57 with respect to adjustment cam 26 means that gripper body 72, and, thus, nose 74, is relatively far away from the uppermost edge of rearward lap 63 at a distance 67. In such a position, even if there is a variation in size of rearward lap 63, nose 74 is sufficiently far away from the uppermost edge of rearward lap 63 to prevent rearward lap 63 from being held by nose 74.

Therefore, the invention allows an operator to raise a gripper system 70 of each of pocket 10 without having to manually adjust each gripper 71 of each pocket 10.

Adjustment device 73 need not be a two-arm rocker lever with a pivot 75. Instead, it can take any form that moves gripper shaft 57 dependent upon an operator-adjustable shaft-setting device 26 such that gripper nose 74 is moved along upper front wall 52 and, therefore, along section 6 to place the end of gripper nose 74 at any position on either or both forward lap 61 and rearward lap 63.

Similarly, the combination and connection of adjustment body 79 and cam follower 77 can take any form. For example, body 79 can have an axle hole (extending into the plane of the views of FIGS. 8 and 9) for receiving an axle or shaft that is then attached to a wheel-shaped cam follower 77. Other equivalent attachment embodiments can be used as well.

Gripper system 70 shown is a linear raising system. In other words, if adjustment cam 26 is raised by $\Delta h$, then gripper body 75 will be pulled into cavity 78 along a distance equal to $\Delta h$. Thus, the difference between 65 and 67 is $\Delta h$. Gripper system 70 does not have to be a linear raising system, however. It is envisioned to have, if desired, a more complex lever system such that a small raising of adjustment cam 26 results in a correspondingly larger or smaller raising of gripper body 75.

Ramp 29 of adjustment cam 26 is depicted as being relatively small and shallow. Of course, ramp 29 can have any length or be at any angle greater than 0 degrees and less than 90 degrees. However, preferably, the length of ramp 29 is at least equal to a radius of cam follower 77. Also preferable is for the ramp angle to be between 30 and 60 degrees, in particular, to be between 30 and 45 degrees. Adjustment cam 26 is shown without a lower surface. Nonetheless, in a preferred embodiment, the forward-most end of ramp 29 is approximately level with such a lower surface and, where cam follower 77 is wheel-shaped, the forward-most portion of adjustment cam is rounded to permit smooth contact between ramp 29 and cam follower 77.

In the embodiment shown, the bottom of cam follower 77 contacts upper surface 27 of adjustment cam 26. Alternatively, the top of cam follower 77 can contact a non-illustrated lower surface of adjustment cam 26. The above-noted example including an axle hole and wheel-shaped cam follower 77 can be used both for contacting upper surface 27 and the lower surface of adjustment cam 27. But, an embodiment can be made so that cam follower 77 only contacts the lower surface. For example, the second rocker arm can have a non-illustrated groove with a width and cam follower 77 can be a wheel rotatably disposed in such a groove, wheel 77 having a width less than the groove width. Wheel 77 can be attached to the second rocker arm with an axle and cotter pin assembly, for example.

In either embodiment, adjustment body can be attached to a non-illustrated bias device, such as a spring, that biases cam follower 77 in a given rotation direction around pivot 75.

FIG. 10 illustrates one embodiment for controlling opening and closing of adjustable gripper 71. Gripper shaft 57 can be connected to a gripper control lever 81. Preferably, gripper control lever 81 is fixedly, but adjustably, connected to gripper shaft 57. For example, gripper control lever 81 releasably clamps to shaft 57 such that, when released, at least to a small extent, gripper control lever 81 can rotate around shaft 57 for manual alignment and adjustment. The distal end of gripper control lever 81 includes a second cam follower 83. Second cam follower 83 can be connected to gripper control lever 81 in any way similar to the connection of cam follower 77. Further, second cam follower 83 can take any form, including the same form as cam follower 77. In a preferred embodiment, second cam follower 83 is a roller that is controlled by a second adjustable cam 85 having a cam surface 87. Second adjustable cam 85 can take any form, including the same form as adjustable cam 26. In an alternative preferred embodiment, adjustable cam 26 and second adjustable cam 85 are linked to one another in some way so that one is dependent upon another, but with each remaining independently adjustable by an operator.

In operation, when second adjustable cam 85 is at a raised position with respect to gripper shaft 57, as illustrated in FIG. 10, gripper shaft 57 is rotated counter-clockwise to place nose 74 against section 6, forward lap 61, and/or rearward lap 63. Alternatively, when second adjustable cam 85 is at a lowered position with respect to gripper shaft 57 (a condition that is not illustrated), gripper shaft 57 is rotated clockwise to move nose 74 away from section 6, forward lap 61, and/or rearward lap 63.

The invention better separates the forward lap from the rearward lap by adjusting grippers in a vertical direction with respect to a pocket so that the forward lap is gripped in the most efficient place.

We claim:

1. An adjustable gripper system for releasably holding at least one sheet against a surface, comprising:

a rotatable gripper shaft having a shaft axis;

at least one gripper connected to said gripper shaft and rotating with said gripper shaft about said shaft axis to selectively hold the at least one sheet against the surface;

a pivot shaft having a pivot axis;

an adjustment body connected to said pivot shaft for pivoting said adjustment body about said pivot axis, said gripper shaft rotatably connected within said adjustment body;

a cam follower to be actuated by a cam, said cam follower connected to said adjustment body for pivoting said adjustment body about said pivot axis; and said adjustment body adapted to displace said gripper shaft about said pivot axis dependent upon a position of the cam to correspondingly displace said gripper along the surface.

2. The gripper system according to claim 1, wherein said at least one gripper is a plurality of grippers spaced apart from one another on said gripper shaft.

3. The gripper system according to claim 1, wherein said at least one gripper is releasably connected to said gripper shaft.

4. The gripper system according to claim 1, wherein said adjustment body is a lever.

5. The gripper system according to claim 1, wherein:

said lever is a rocker having two ends;

a first of said ends is connected to said cam follower; and said gripper shaft is rotatably connected within a second of said ends.

6. The gripper system according to claim 1, wherein said gripper shaft is journaled in said adjustment body.

7. The gripper system according to claim 5, wherein said cam follower is a wheel and an axle rotatably connecting said wheel to said second end.

8. The gripper system according to claim 1, wherein said gripper shaft is to be connected to a second cam for rotating said gripper shaft about said shaft axis.

9. A method for adjustably gripping at least one sheet within a sheet-receiving pocket of a sheet-collating device, which comprises:

conveying sheet-receiving pockets along a transport path, each of the pockets having:

forward and rearward walls pivotally connected to one another, the forward wall having a top portion; and at least one adjustable gripper system according to claim 1, the gripper of the gripper system having a holding portion for holding at least a portion of a sheet deposited in a respective one of the pockets, the gripper disposed at the top portion;

selectively placing a cam into a position in the transport path of the pockets;

contacting each of the pockets with the cam to selectively move the holding portion of the gripper dependent upon the selected position of the cam; and while retaining contact between the cam and the pocket:

opening the forward and rearward walls of each of the pockets to create a sheet-receiving opening;

conveying the pockets past a sheet-feeding device; and feeding the sheet into the sheet-receiving opening from the sheet feeding device to place the portion of the sheet against the forward wall; and securely gripping at least the portion of the sheet against the forward wall with the holding portion of the gripper.

10. The method according to claim 9, which further comprises transporting the gripped sheet in the pocket along at least a portion of the conveyor.

11. A method for adjusting grippers of sheet-receiving pockets, which comprises:

providing sheet-receiving pockets to be conveyed in a transport path, each pocket having:

a top portion; and at least one adjustable gripper system according to claim 1, the gripper of the gripper system having a holding portion for holding at least a portion of a sheet deposited in the pocket, the gripper disposed at the top portion; and positioning an adjustable cam in the transport path of the pockets to contact each of the pockets and selectively displace the holding portion of the gripper dependent upon a set position of the cam such that the portion of the sheet is securely gripped within the pocket with the holding portion of the gripper while contact exists between the cam and the pocket.

12. An adjustable gripper system for releasably holding at least one sheet against a surface, comprising:

a rotatable gripper shaft having a shaft axis;

an adjustment body adapted to displace said gripper shaft;

at least one rotatable gripper for selectively holding the at least one sheet against the surface, said gripper being rotatably connected to said gripper shaft and connected to said adjustment body; and a cam follower to be actuated by a cam, said cam follower connected to said adjustment body and adapted to displace said adjustment body to correspondingly displace said gripper shaft dependent upon a position of the cam and correspondingly displace said gripper along the surface.

13. A sheet-collating pocket, comprising:

a forward wall having an upper end portion;

a rearward wall pivotally connected to said forward wall for moving towards and away from said forward wall, said rearward wall and said forward wall together defining an opening for receiving at least one sheet; and an adjustable gripper system for releasably holding the at least one sheet against said forward wall, said gripper system disposed at said upper end portion and having:

a rotatable gripper shaft having a shaft axis;

an adjustment body adapted to displace said gripper shaft;

at least one rotatable gripper for selectively holding the at least one sheet against said forward wall, said gripper being rotatably connected to said gripper shaft and connected to said adjustment body; and a cam follower to be actuated by a cam, said cam follower connected to said adjustment body and adapted to displace said adjustment body to correspondingly displace said gripper shaft dependent upon a position of the cam and correspondingly displace said gripper said forward wall.

14. The pocket according to claim 13, wherein:

the pocket travels in a given direction; and said forward wall is disposed downstream of said rearward wall with respect to said given direction.

15. The pocket according to claim 13, wherein said upper end portion is an upper third of said forward wall.

16. The pocket according to claim 13, wherein said upper end portion is an upper fourth of said forward wall.

17. The pocket according to claim 13, wherein said upper end portion is an upper fifth of said forward wall.

18. The pocket according to claim 13, wherein said forward wall has a top and said gripper system is disposed substantially at said top.

19. A sheet-collating pocket, comprising:

a forward wall having an upper end portion;

a rearward wall pivotally connected to said forward wall for moving towards and away from said forward wall, said rearward wall and said forward wall together defining an opening for receiving at least one sheet; and an adjustable gripper system for releasably holding the at least one sheet against said forward wall, said gripper system disposed at said upper end portion and having:

a rotatable gripper shaft with a shaft axis;

at least one gripper connected to said gripper shaft and rotating with said gripper shaft about said shaft axis to selectively hold the at least one sheet against said forward wall;

a pivot shaft having a pivot axis;

an adjustment body connected to said pivot shaft for pivoting said adjustment body about said pivot axis, said gripper shaft rotatably connected within said adjustment body;

a cam follower to be actuated by a cam, said cam follower connected to said adjustment body for pivoting said adjustment body about said pivot axis; and said adjustment body adapted to displace said gripper shaft about said pivot axis dependent upon a position of the cam to correspondingly displace said gripper along said forward wall.

20. In a sheet-collating pocket having a top, a forward wall, and a rearward wall pivotally connected to said forward wall, the rearward and forward walls together defining an opening for receiving at least one sheet from the top, an adjustable gripping system for setting placement of grippers at the top of the pocket, the gripping system comprising:

a rotatable gripper shaft having a shaft axis;

an adjustment body adapted to displace said gripper shaft;

at least one rotatable gripper for selectively holding the at least one sheet against the forward wall, said gripper being rotatably connected to said gripper shaft and connected to said adjustment body; and a cam follower to be actuated by a cam, said cam follower connected to said adjustment body and adapted to displace said adjustment body to correspondingly displace said gripper shaft dependent upon a position of the cam and correspondingly displace said gripper along the forward wall.

21. In a sheet-collating pocket having a top, a forward wall, and a rearward wall pivotally connected to said, forward wall, the rearward and forward walls together defining an opening for receiving at least one sheet from the top, an adjustable gripping system for setting placement of grippers at the top of the pocket, the gripping system comprising:

a rotatable gripper shaft having a shaft axis;

at least one gripper connected to said gripper shaft and rotating with said gripper shaft about said shaft axis to selectively hold the at least one sheet against the forward wall;

a pivot shaft having a pivot axis;

an adjustment body connected to said pivot shaft for pivoting said adjustment body about said pivot axis, said gripper shaft rotatably connected within said adjustment body;

a cam follower to be actuated by a cam, said cam follower connected to said adjustment body for pivoting said adjustment body about said, pivot axis; and said adjustment body adapted to displace said gripper shaft about said pivot axis dependent upon a position of the cam to correspondingly displace said gripper along the forward wall.

22. A sheet-collating machine, comprising:

a conveyor adapted to travel along a transport direction;

at least one sheet feeding device disposed at said conveyor for feeding at least one sheet towards said conveyor;

a plurality of sheet-collating pockets, each of said pockets:

connected to said conveyor;

adapted to receive the at least one sheet from said at least one sheet feeding device; and adapted to transport the at least one sheet along at least a portion of said conveyor in said transport direction;

an adjustable cam having an adjustment device adapted to displace said cam in different positions with respect to said pockets, said cam disposed at said conveyor and adapted to selectively contact each of said pockets as each pocket respectively passes thereby; and each of said pockets having:

a forward wall with an upper end portion;

a rearward wall pivotally connected to said forward wall, said rearward wall and said forward wall together defining an opening for receiving at least one sheet; and an adjustable gripper system for releasably holding the at least one sheet against said forward wall, said gripper system disposed at said upper end portion and having:

a rotatable gripper shaft having a shaft axis;

an adjustment body adapted to displace said gripper shaft;

at least one rotatable gripper for selectively holding the at least one sheet against said forward wall, said gripper being rotatably connected to said gripper shaft and connected to said adjustment body; and a cam follower actuated by said cam, said cam follower connected to said adjustment body and adapted to displace said adjustment body to correspondingly displace said gripper shaft dependent upon a position of said cam and correspondingly displace said gripper along said forward wall.

23. A sheet-collating machine, comprising:

a conveyor adapted to travel along a transport direction;

at least one sheet feeding device disposed at said conveyor for feeding at least one sheet towards said conveyor;

a plurality of sheet-collating pockets, each of said pockets:

connected to said conveyor;

adapted to receive the at least one sheet from said at least one sheet feeding device; and adapted to transport the at least one sheet along at least a portion of said conveyor in said transport direction;

an adjustable cam having an adjustment device adapted to displace said cam in different positions with respect to said pockets, said cam disposed at said conveyor and adapted to selectively contact each of said pockets as each pocket respectively passes thereby; and each of said pockets having:

a forward wall with an upper end portion;

a rearward wall pivotally connected to said forward wall, said rearward wall and said forward wall together defining an opening for receiving at least one sheet; and an adjustable gripper system for releasably holding the at least one sheet against said forward wall, said gripper system disposed at said upper end portion and having:

a rotatable gripper shaft having a shaft axis;

at least one gripper connected to said gripper shaft and rotating with said gripper shaft about said shaft axis to selectively hold the at least one sheet against said forward wall;

a pivot shaft having a pivot axis;

an adjustment body connected to said pivot shaft for pivoting said adjustment body about said pivot axis, said gripper shaft rotatably connected within said adjustment body;

a cam follower actuated by said cam, said cam follower connected to said adjustment body for pivoting said adjustment body about said pivot axis; and said adjustment body adapted to displace said gripper shaft about said pivot axis dependent upon a position of said cam to correspondingly displace said gripper along said forward wall.

* * * * *